US005275763A

United States Patent [19]

Fukai

[11] Patent Number: 5,275,763

[45] Date of Patent: Jan. 4, 1994

[54] NOZZLE FOR GENERATING BUBBLES

[76] Inventor: Toshiharu Fukai, 1112-1, Ooaza-hakeyama, Mimaki-mura, Kitakata-gun, Nagano, Japan

[21] Appl. No.: 966,331

[22] Filed: Oct. 26, 1992

[51] Int. Cl.[5] ..... B01F 3/04

[52] U.S. Cl. ..... 261/78.2; 261/DIG. 26; 169/15

[58] Field of Search ..... 261/78.2, DIG. 26; 169/15

[56] References Cited

U.S. PATENT DOCUMENTS

| | | | |
|---|---|---|---|
| 1,927,376 | 9/1933 | Schroder et al. | 261/DIG. 26 |
| 2,540,064 | 1/1951 | Weber | 261/DIG. 26 |
| 2,645,292 | 7/1953 | Williams | 261/DIG. 26 |
| 2,826,399 | 3/1958 | Eriksson | 261/DIG. 26 |
| 2,934,149 | 4/1960 | Bedford et al. | 261/DIG. 26 |
| 2,988,343 | 6/1961 | Edwards et al. | 261/DIG. 26 |
| 3,094,171 | 6/1963 | Gagliardo | 261/DIG. 26 |
| 3,388,868 | 6/1968 | Watson et al. | 261/DIG. 26 |
| 4,000,992 | 1/1977 | Cole, Jr. | 261/DIG. 26 |
| 4,135,882 | 1/1979 | Harkness | 261/DIG. 26 |
| 4,213,936 | 2/1980 | Lodrick | 261/DIG. 26 |

FOREIGN PATENT DOCUMENTS

| | | | |
|---|---|---|---|
| 1065955 | 6/1954 | France | 261/DIG. 26 |

*Primary Examiner*—Tim Miles
*Attorney, Agent, or Firm*—Lorusso & Loud

[57] ABSTRACT

A nozzle for continuously generating a foam is used for the purpose of bathing, cleaning, fire extinguishing, sterilizing or the like. The nozzle includes as essential components a chemical agent liquid mixture preparing unit, a cylindrical holder to be held in by a user's hand, an injection nozzle attached to the foremost end of the holder for ejecting a chemical agent liquid mixture as a spray, a cylindrical sleeve secured to the holder with a diameter larger than that of the holder, air intake ports formed through the cylindrical sleeve, and a screen fixedly secured to the foremost end of the cylindrical sleeve for allowing a mixture of the ejected spray and the introduced air to collide therewith and thereby generate a foam. The distance between the injection nozzle and the screen can be adjusted, and moreover, the flow rate of air to be introduced into the cylindrical sleeve through the intake air ports can be adjusted. To this end, the cylindrical sleeve is displaceably threadably engaged with the holder and an annular adjustment cover is displaceably fitted around the cylindrical sleeve.

7 Claims, 3 Drawing Sheets

NOZZLE FOR GENERATING BUBBLES

BACKGROUND OF THE INVENTION

1. Field of the Invention

The present invention relates generally to a foam generating nozzle. More particularly, the present invention relates to a nozzle for continuously generating foam wherein the nozzle can be employed for the purpose of bathing, cleaning, fire extinguishing, sterilizing or the like by continuously ejecting from the nozzle a spray of a chemical agent liquid mixture and then generating an air filled foam.

2. Description of the Related Art

It has been known that when a chemical agent properly selected for its intended application such as cleaning, fire extinguishing or the like is ejected in the form of foam, cleaning, fire extinguishing or the like can be achieved at a high efficiency with the chemical agent consumed in a small quantity, since the chemical agent remains at a predetermined location or in a predetermined region for a long time.

In view of the above, in recent years, can-shaped containers each having a comparatively small volume while containing chemical agents and high pressure gas or compressed air are practically used as fire extinguishers or as cleaners for a bath tub, a kitchen or other household articles by ejection of the chemical agents in the form of a foam. However, since each of the conventional can-shaped containers contains chemical agents and high pressure gas in only a limited small quantity, their practical application is unavoidably restricted within a narrow range. In other words, they can be used only in a case where chemical agents and high pressure gas, in the form of a foam are required in a small quantity. Another problem is that the so-called flon gas has been usually used in the can-shaped containers of the aforementioned type.

When a large quantity of chemical agents is used in the form of a foam, the chemical agents and high pressure gas are filled at an increased cost. For this reason, it is necessary to develop improved technical means for easily filling each can shaped container with a large quantity of chemical agents and high pressure gas.

An example of a foam generating nozzle serving as means for generating a large amount of chemical foam is the foam type fire extinguisher disclosed Japanese Patent Laid-Open Publication No. 1-259874. According to this prior art, an injector type nozzle tip is disposed in a sleeve for the nozzle so that foam generating liquid is introduced into the fire extinguisher by the action of negative pressure induced by a jet stream of pressurized water to mix the foregoing liquid with the pressurized water. The resultant liquid mixture is ejected through the nozzle tip toward a deflector disposed in front of the nozzle tip so that it collides with the deflector to thereby form a foam serving as a fire extinguishing chemical agent. In addition, a movable sleeve is displaceably received in the nozzle sleeve so as to allow the distance between the foremost end of the movable sleeve and the deflector to be properly adjusted in order to eject or spray the fire extinguishing agent directly toward an item to be extinguished.

The fire extinguisher constructed according to the foregoing prior art is intended to generate a large amount of foam serving as a fire extinguishing agent, using a large quantity of high pressure water. Thus, when this fire extinguisher is employed for an individual dwelling house, use with low pressure tap water causes a number of problems noted below. Specifically, with mixing means having an injector type nozzle tip, a small magnitude of aspirating force is generated by the stream of low pressure water, resulting in a failure in the introduction of the foamable chemical agent into the fire extinguisher. In addition, since the liquid mixture has a comparatively low pressure, only a small quantity of foam is generated when it collides with the plate-shaped deflector. Additionally, due to the fact that the foam generating means, including the deflector, does not include any adjusting means, when pressure of the pressurized water or the kind of chemical agent is changed, the fire extinguisher can not cope with the change, and moreover, can not adjust the physical properties of the foam.

As is apparent from the above description, the conventional fire extinguisher for generating a foam of a chemical agent liquid mixture can not be employed for all of various kinds of applications such as cleaning, fire extinguishing and others. Thus, there arises the need to provide a plurality of foam generating nozzles corresponding to all the foregoing applications.

SUMMARY OF THE INVENTION

The present invention has been made in consideration of the foregoing background.

An object of the present invention is to provide a nozzle for continuously generating a foam wherein the nozzle can effectively be employed for the purpose of bathing, cleaning, fire extinguishing, sterilizing or the like using a chemical agent liquid mixture.

Another object of the present invention is to provide a nozzle for continuously generating a foam wherein physical properties of the foam can be adjusted in accordance with variation of pressure of the chemical agent liquid mixture or the like.

According to one aspect of the present invention, there is provided a nozzle for continuously generating a foam, wherein the apparatus comprises a chemical agent liquid mixture preparing unit into which water, hot water and chemicals are supplied to prepare a desired chemical agent liquid mixture; a cylindrical holder to be held by a user's hand, the cylindrical holder serving to allow the chemical agent liquid mixture to be delivered from the chemical agent liquid mixture preparing unit therethrough at a predetermined flow rate and in a pressurized state; an injection nozzle attached to the foremost end of the holder for ejecting the chemical agent liquid mixture in spray form; a cylindrical sleeve secured to the holder with a diameter larger than that of the holder, the cylindrical sleeve having a hollow space into which the chemical agent liquid mixture is ejected from the injection nozzle in the form of a spray; at least one intake air port formed through the cylindrical sleeve, and a screen fixedly secured to the foremost end of the cylindrical sleeve for allowing the spray mixture from the injection nozzle and the air introduced through the intake air ports to collide and then dispersively expand while passing therethrough to generate a foam composed of the chemical agent liquid mixture.

From the viewpoint of practical use, it is desirable that the distance between the injection nozzle and the screen can be adjusted, and moreover, that the flow rate of air introduced through the intake air ports can be adjusted.

In addition, it is desirable that the screen can be exchanged with another one, if necessary.

To assure that the flow rate of air introduced into the cylindrical sleeve is properly adjusted, an annular adjustment cover is displaceably fitted around the cylindrical sleeve.

Further, according to other embodiment of the present invention, there is provided a nozzle for continuously generating a foam, wherein the apparatus includes a chemical agent liquid mixture preparing unit into which water, hot water and chemicals are supplied to prepare a desired liquid chemical agent and a cylindrical holder to be grasped by the user's hand, the cylindrical holder serving to allow the chemical agent liquid mixture to be delivered from the chemical agent liquid mixture preparing unit therethrough at a predetermined flow rate in a pressurized state. A plurality of male threads are formed around the outer fore end surface of the holder and an injection nozzle is threadably secured thereon. Male threads are formed around the outer surface of the injection nozzle, and a plurality of female threads are formed around its inner surface. A cylindrical sleeve is threadably secured to the outer surface of the injection nozzle and has a diameter larger than that of the holder, the cylindrical sleeve having a hollow space into which the chemical agent liquid mixture is injected from the injection nozzle in the form of a spray. A plurality of female threads are formed around the inner surface of a small-diameter portion of the cylindrical sleeve at the rear end of same for engaging the nozzle and at least one intake air port is formed through the cylindrical sleeve. A screen is fixedly secured to the foremost end of the cylindrical sleeve for mixing the spray ejected from the injection nozzle and the air introduced through the intake air port thereby generating a foam composed of the chemical agent liquid mixture.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate preferred embodiments of the present invention.

Figure 1:
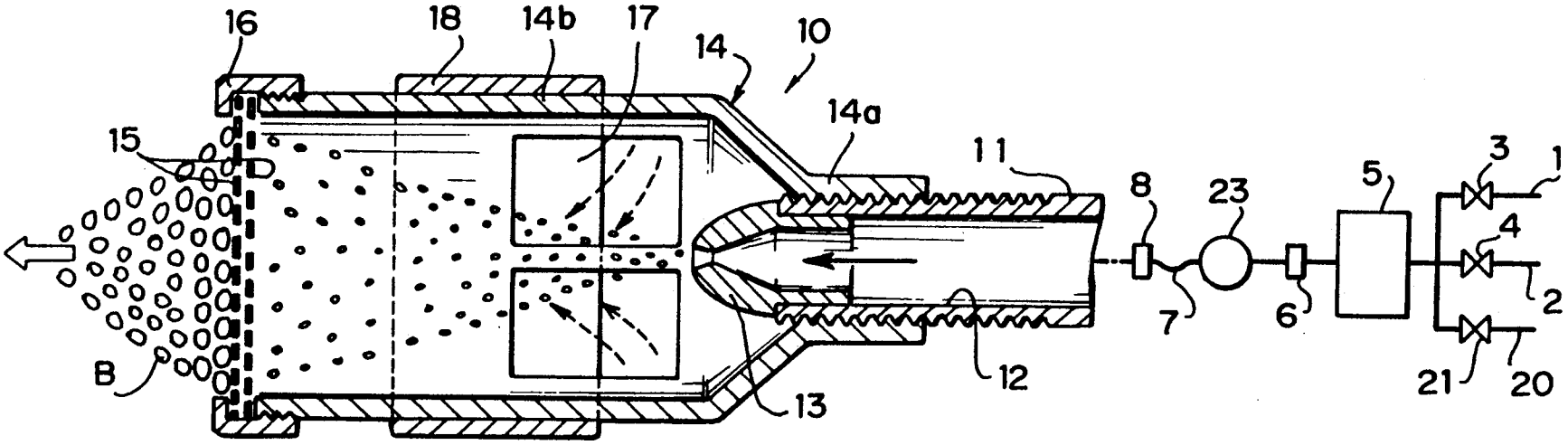
FIG. 1 is a sectional view of a nozzle for continuously generating a foam in accordance with an embodiment of the present invention.
Figure 2:
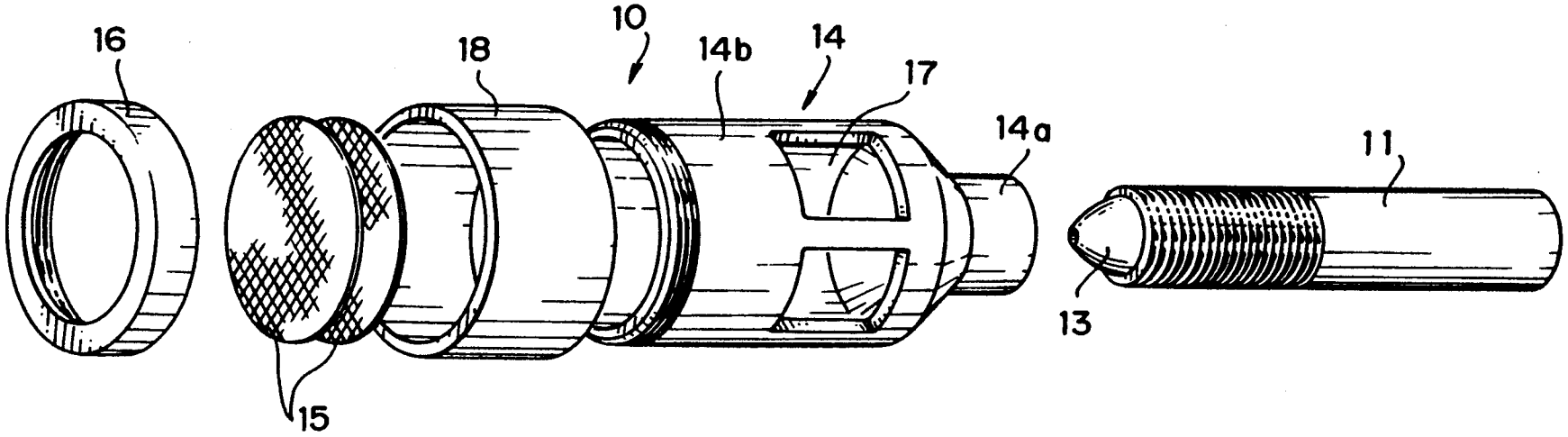
FIG. 2 is a perspective view of the nozzle shown in FIG. 1 in the disassembled state.

FIG. 1 and FIG. 2 illustrate a nozzle for continuously generating a foam in accordance with an embodiment of the present invention, from a mixture of tap water, hot water and chemicals. In FIG. 1, reference numeral 1 designates piping for tap water, reference numeral 2 designates piping for hot water heated in a water heater, and reference numeral 20 designates piping for supplying chemical agents therethrough. The water piping 1, the hot water piping 2 and the chemical agent piping 20 are connected to a chemical agent liquid mixture preparing unit 5 via valves 3, 4 and 21. The unit 5 is supplied with water and hot water to mix with chemical agents suitably employable for various purposes of cleaning, bathing, fire extinguishing or the like, in a predetermined ratio, and the resultant chemical agent mixture A is prepared in the unit 5. A motor driven pump 23 is disposed at an intermediate position in a flexible pipe 7 to deliver that the chemical agent liquid mixture A while substantially constant pressure is maintained. As is apparent from FIG. 1, the chemical agent liquid mixture preparing unit 5 is connected to a foam generating nozzle 10 via a coupling 6, the flexible pipe 7 and another coupling 8.

The foam generating nozzle 10 includes an elongated tube-shaped holder 11 connected to the flexible pipe 7, and an injection nozzle 13 is attached to the foremost end 12 of the holder 11 in order to eject the chemical agent liquid mixture A with a predetermined expansion angle. A cylindrical sleeve 14 large enough to receive the spray is arranged ahead of and outside of the injection nozzle 13. The sleeve 14 is integrally constructed of a small-diameter portion **14*a* threadably engaged with the holder 11 and a large-diameter portion 14*b* having a diameter larger than that of the portion 14*a*, joined in a stepped configuration. A screen 15 is fixedly secured to the foremost end of the large-diameter portion 14*b* with the aid of a fixing cap 16, opposite to the injection nozzle 13. The fixing cap 16 is threadably engaged on the foremost end of the sleeve 14. Thus, the screen 15 can be exchanged with another one by disengaging the fixing cap 16 from the sleeve 14**.

A method of continuously generating a foam in accordance with the present invention includes the steps of mixing air with a spray of the chemical agent liquid mixture A ejected from the injection nozzle 13 in the sleeve 14, colliding the mixture of air and chemical agent liquid mixture A against the screen 15 at a high speed and then expanding the spray of the ejected chemical agent liquid mixture A while passing through the screen 15 to generate an air-filled foam composed of a chemical agent B.

The physical properties of the foam will vary depending on the mesh size of the screen 15, the chemical composition of the chemical agent liquid mixture A, the mixing ration of water to hot water and the quantity of air mixed with the chemical agent liquid mixture A, water and hot water.

The screen 15 makes it possible to change from a very fine bubble foam to a large soap bubble foam.

The impact force of the liquid mixture colliding against the screen 15 will vary depending on chemical properties of the chemical agents, pressure of the chemical agent liquid mixture A and size of the injection nozzle 13. In practice, it has been confirmed based on the results derived from experiments that the impact force has a significant affect on generation of a foam of a chemical agent B and properties of the foam. The foam generating nozzle can cope with variation of the physical properties of the foam by changing the distance between the injection nozzle 13 and the screen 15. Specifically, since the small-diameter portion **14*a* of the sleeve 14 is threadably engaged with the holder 11, the position of the screen 15 relative to the injection nozzle 13 can be changed as desired by rotating the sleeve 14** relative to the holder 11. Alternatively, the sleeve 14 may be designed to be expansible and contractible in order to change the position of the screen 15 relative to the injection nozzle 13.

It should be added that the quantity of air introduced into the sleeve 14 has a significant affect on variation of the physical properties of the foam. It has been experimentally confirmed that the spray of the chemical agent liquid mixture A from the injection nozzle 13 into the interior of the sleeve 14 at a high speed and the high speed stream of the chemical agent liquid mixture A so formed cause ambient air to be mixed with the chemical agent liquid mixture A.

Air intake ports 17 are formed through the large-diameter portion **14*b* of the sleeve 14, and an annular adjustment cover 18 is slidably fitted around the large-diameter portion 14*b* of the sleeve 14. Alternatively, the adjustment cover 18 may be threadably fitted around the large-diameter portion 14*b* of the sleeve 14. As the position of the adjustment cover 18 is changed, the total opening of the air intake ports 17 varies correspondingly, thereby adjusting the quantity of air introduced into the sleeve 14 through the air intake ports 17**.

Next, a mode of operation of the foam generating nozzle constructed in the aforementioned manner will be described below.

First, a chemical agent suitably employable for cleaning of a bath tub is prepared in the chemical agent liquid mixture preparing unit 5. Next, when the valve 3 on the water piping 1 is opened, tap water flows into the chemical agent liquid mixture preparing unit 5 at a predetermined flow rate, causing the chemical agents to be mixed with the water and, thereafter, the resultant chemical agent liquid mixture A is delivered to the foam generating nozzle 10 by the pump 23, whereby it is dispersively ejected from the injection nozzle 13 at a high speed as a spray. At this time, a quantity of air corresponding to the total open area of the air intake ports 17 is uniformly mixed with the ejected spray of the chemical agent liquid mixture A so that the resultant mixture of liquid spray and air collides against the screen 15 at a high speed. As the spray of the mixture which has collided against the screen 16 passes through the screen 15, it is expansively deformed into an air-filled foam, whereby a large amount of foam composed of the chemical agent B is continuously generated in the region adjacent the outside of the screen 15. This foam is ejected toward a bath tub to be cleaned.

The bubble size of chemical agent foam B is increased as the mesh size of the screen 15 is increased. As the screen 15 is moved nearer to the injection nozzle 13, the foam can be ejected over a longer distance. In addition, as the total open area of the air intake ports 17 is enlarged to increase the quantity of intake air, the viscosity of the foam is reduced, i.e., the adhering force between the bubbles decreases. Thus, a foam composed of the chemical agent B can be generated and ejected toward a bath tub to be cleaned at a high speed by properly selecting the kind of screen 15, and moreover, correctly adjusting the position of the screen 15 relative to the injection nozzle 13 and the total open area of the air intake ports 17.

Figure 3:
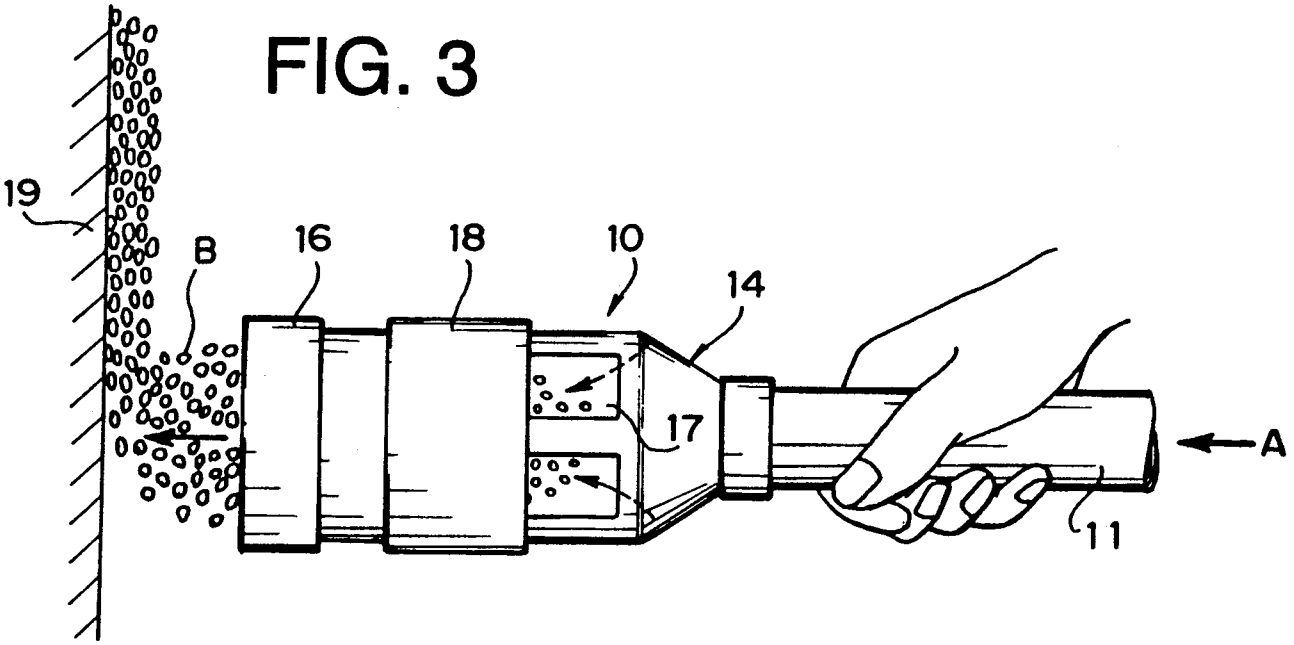
FIG. 3 is a perspective view illustrating use of the nozzle of the present invention continuously ejecting a foam for the purpose of cleaning a bath tub.

FIG. 3 illustrates by way of example that a bath tub 19 is cleaned using the foam generating nozzle of the present invention. A user grasps the holder 11 of the foam generating nozzle 10 with his hand to continuously eject a foam composed of the chemical agent B toward the bath tub 19. When the bath tub 19 is cleaned using the foam generating nozzle 10, it is desirable that the foam composed of the chemical agent B adheres to the bath tub 19 for a long time. For this purpose, the total open area of the air intake ports 17 is set to be small, i.e. to enhance the cleaning of the bath tub 19. Thereafter, water is sprayed over the surface of the bath tub 19 until the chemical agent B is entirely washed off. At this point, cleaning of the bath tub 19 has been completed.

Figure 4:
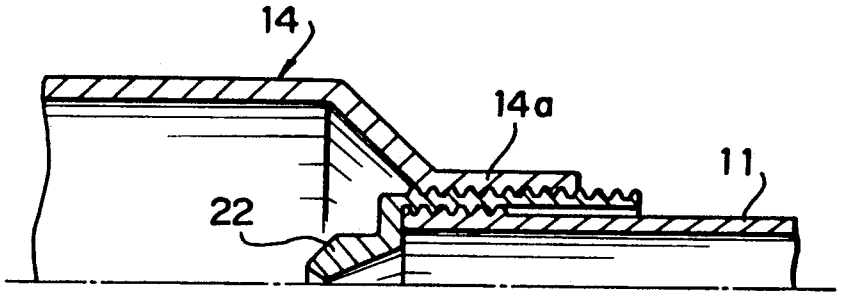
FIG. 4 is a fragmentary sectional view of a nozzle for continously generating a foam in accordance with another embodiment of the present invention.

A foam generating nozzle in accordance with another embodiment of the present invention will be described below with reference to FIG. 4 wherein an injection nozzle can be exchanged with another one as desired.

In this embodiment, an injection nozzle 22 is made of a cylindrical sleeve with its outer surface male-threaded and its inner surface female-threaded. A holder 11 is threadably engaged with the female threads on the inner surface of the injection nozzle 22, while a small-diameter portion **14*a* of a cylindrical sleeve 14 is threadably engaged with male threads on the outer surface of the injection nozzle 22. With this construction, the injection nozzle 22** can be exchanged for another one, in accordance with variation of the physical properties of the foam composed of the chemical agent B.

When hot water and compressed air are used in addition to chemical agents to prepare a chemical agent liquid mixture A, the operation of generating foam composed of the chemical agent B will vary correspondingly. To cope with the foregoing variation, another kind of chemical agent mixture liquid A is prepared in the chemical agent liquid mixture preparing unit 5 to continuously generate foam composed of another kind of chemical agent B. In addition, various kinds of washing operations can be performed on various surfaces, e.g., of a building, a floor surface, a vehicle body or the like. Where a user's body is to be washed using a bathing cleaner or fire is to be extinguished with the foam, it is obvious that the kind of chemical agent liquid mixture A should be changed to correspond to the kind of usage of the foam generating nozzle.

While the present invention has been described above with respect to two preferred embodiments thereof, it should of course be understood that the present invention should not be limited only to these embodiments but that various changes or modifications may be made without departure from the scope of the present invention as defined by the appended claims.

What is claimed is:

1. A nozzle assembly for continuously foaming a pressurized liquid chemical comprising:

an injection nozzle including a cylindrical portion having internal and external threads;

a cylindrical member threadably secured inside said injection nozzle for delivering the pressurized liquid chemical to said injection nozzle;

a cylindrical sleeve member defining a hollow space for admixing the pressurized liquid chemical with air to form a foam, said cylindrical sleeve being threadably secured at one end to said external threads of said injection nozzle, the threaded connection between said cylindrical sleeve and said injection nozzle allowing the cylindrical sleeve to be selectively axially positioned relative to said injection nozzle, said cylindrical sleeve having an open end opposite said one end and at least one air intake port for admission of air to be admixed with the liquid chemical; and an apertured member covering and secured to said open end of said cylindrical sleeve for dispersing the admixture of air and liquid chemical as a foam.

2. A nozzle assembly in accordance with claim 1 wherein said apertured member is a screen.

3. A nozzle assembly in accordance with claim 1 further comprising an annular retainer threadably secured to said open end of said cylindrical sleeve for securing said apertured member on said open end of said cylindrical sleeve.

4. A nozzle assembly in accordance with claim 3 wherein said apertured member is a screen.

5. The nozzle assembly of claim 1 further comprising an annular cover displacably fitted around said cylindrical sleeve for selectively covering and uncovering said air intake port to thereby adjust the amount of air admitted into the interior of said cylindrical sleeve.

6. A nozzle assembly in accordance with claim 5 further comprising an annular retainer threadably secured to said open end of said cylindrical sleeve for securing said apertured member on said open end of said cylindrical sleeve.

7. A nozzle assembly in accordance with claim 6 wherein said apertured member is a screen.

* * * * *